United States Patent [19]

Garrett

[11] 4,055,033

[45] Oct. 25, 1977

[54] CAM OPERATED COMPRESSION MOLDING APPARATUS

[76] Inventor: Buford C. Garrett, 412 Brook Glenn Road, Taylors, S.C. 29687

[21] Appl. No.: 752,095

[22] Filed: Dec. 20, 1976

[51] Int. Cl.[2] ..... B65B 11/50; B65B 63/02

[52] U.S. Cl. ..... 53/122; 17/32; 425/297

[58] Field of Search ..... 53/122; 17/32; 425/297

[56] References Cited

U.S. PATENT DOCUMENTS

| | | | |
|---|---|---|---|
| 2,759,308 | 8/1956 | Nawrocki | 53/122 |
| 3,188,780 | 6/1965 | Mead | 53/122 X |

*Primary Examiner*—Travis S. McGehee
*Attorney, Agent, or Firm*—B. P. Fishburne, Jr.

[57] ABSTRACT

A single rotationally driven cam plate having cam follower grooves in its opposite faces generates and coordinates the movements of all apparatus components necessary to the product molding apparatus. The advancing and retracting of mold halves is coordinated through the rotating cam plate and directly associated mechanisms with the cutting off of pieces of moldable stock and the carrying of such pieces to a position for charging the mold. In conjunction with these operations and in properly timed relationship, the stock is advanced to a new cutting position. Certain of the cam driven mechanisms also act in proper sequence to advance molded product encapsulating films through a film guidance means and to operate film clamping and severing devices in such a way that the encapsulating film is always severed midway between molded product units.

32 Claims, 21 Drawing Figures

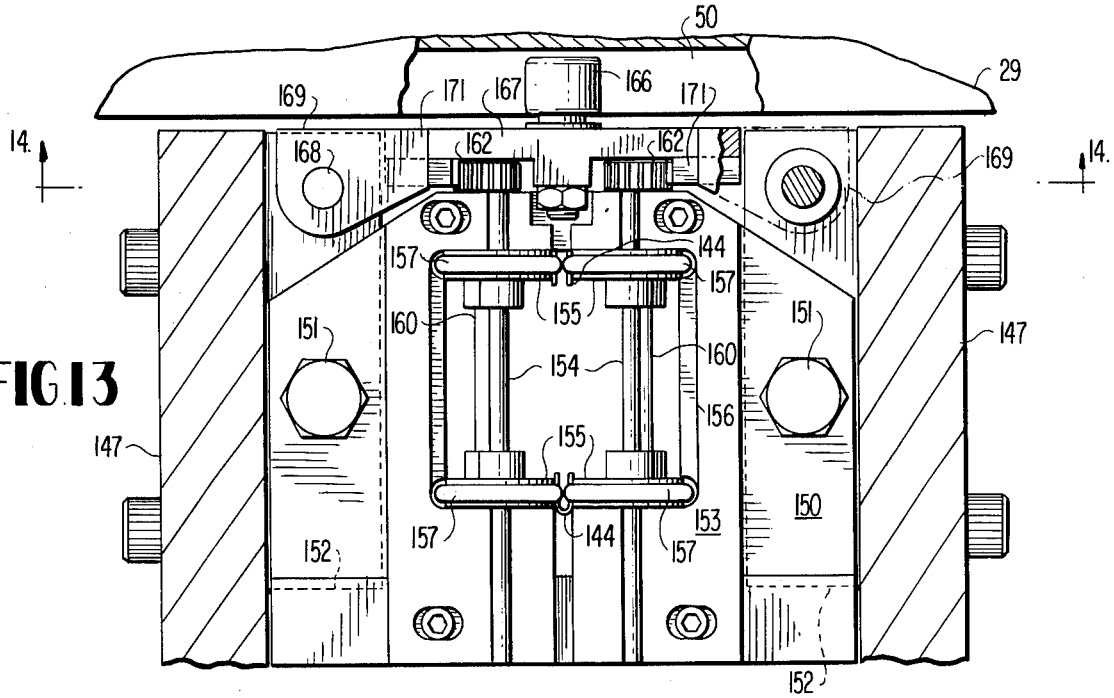
FIG. 13
FIG. 14
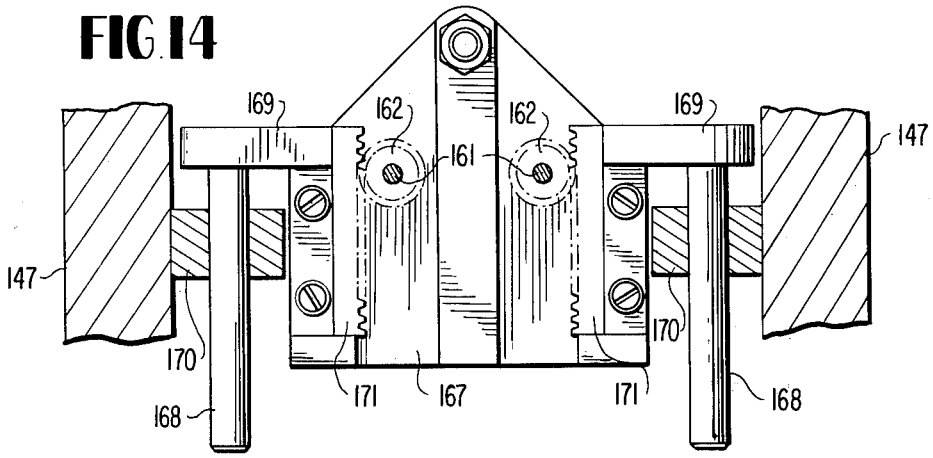
FIG. 15
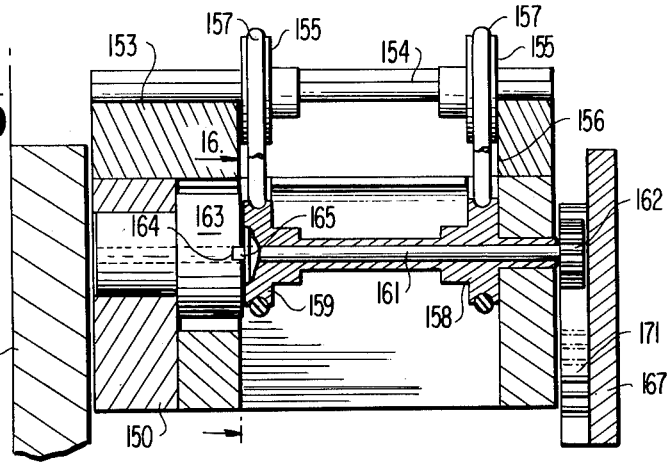
FIG. 16
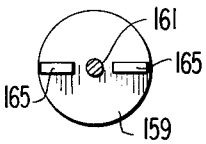

FIG.17
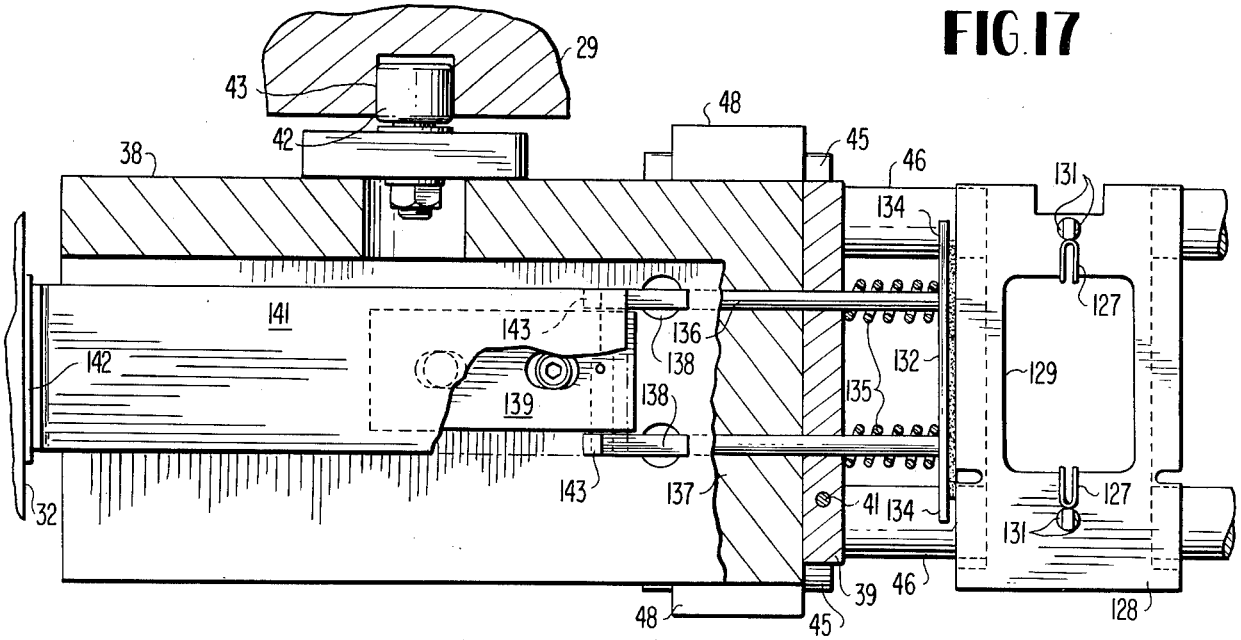
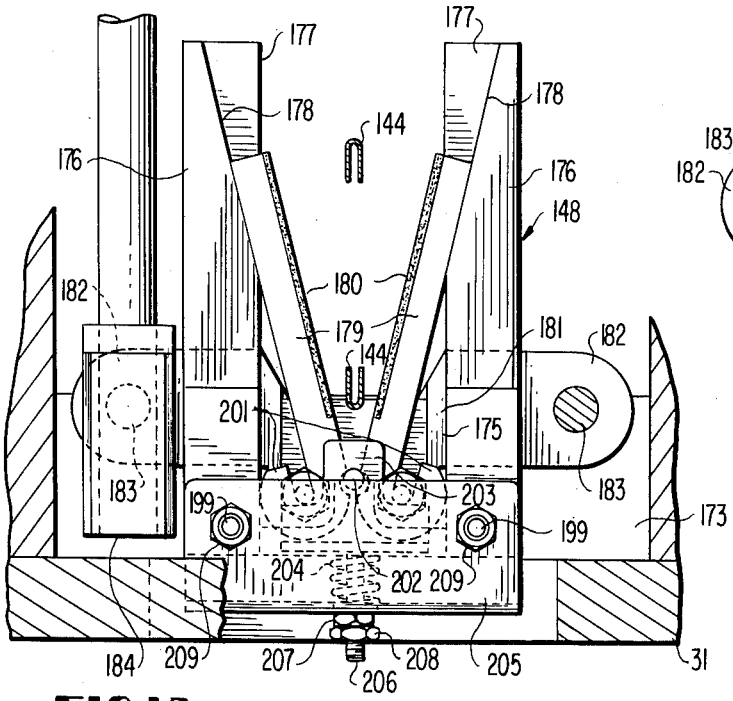
FIG.18
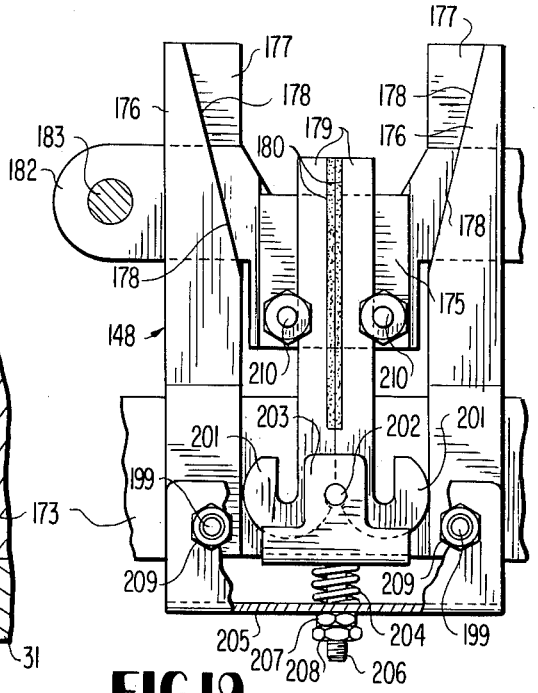
FIG.19
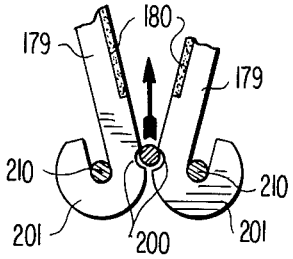
FIG.18A
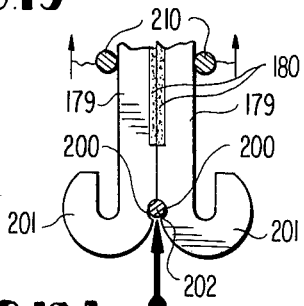
FIG.19A

CAM OPERATED COMPRESSION MOLDING APPARATUS

BACKGROUND OF THE INVENTION

The invention has arisen as a result of a need for a more reliable, efficient and less troublesome molding apparatus which is purely mechanical in its operation so as to avoid the necessity for hydraulic or pneumatic power devices. In the invention, the movements of all essential apparatus components are derived from a single grooved cam plate which is rotationally driven. Directly associated with the rotating cam plate are mechanisms which convert the rotational cam plate movement into linear movements which are necessary to motivate certain parts of molding apparatus. Among these parts which must be motivated on linear paths in properly timed relationship by the single rotating cam plate are opposing mold halves or sections which mold the product units into the desired shape. In this connection, the apparatus is adapted to mold food products such as candy or butter, as well as plastic objects or other utilitarian products including certain electrical components having molded bodies.

In connection with the molding of foods, a main feature of the apparatus involves the mounting of parts which come into contact with the food stock for easy removal and cleaning, such parts being preferably formed of stainless steel.

Additional apparatus components which must be moved on linear paths in timed relationship with other components are a means to sever from the bottom of the product stock pieces of a proper size for charging the mold during each repetitive cycle of operation; another means closely associated with the mold charging means to advance the stock preparatory to cutting another piece therefrom; another means for advancing strips of product encapsulating film; and means closely associated with the film advancing means to clamp the film at two points below the mold halves and to sever the film cleanly midway between each molded encapsulated product unit.

In the invention, all of the above-stated operational capabilities are embodied in a comparatively simple and compact machine which is rugged in construction, resistant to wear and involves few adjustments. Throughout the apparatus including the mold halves, the need for hand fitted parts or perfectly matched parts is avoided. Despite this, the apparatus is characterized by extreme accuracy and uniform repeatability of operation.

Other features and advantages of the invention will become apparent during the course of the following detailed description.

BRIEF DESCRIPTION OF THE DRAWINGS

FIG. 13 is a horizontal section taken on line 13—13 of FIG. 12.

FIG. 14 is a fragmentary vertical section taken on line 14—14 of FIG. 13.

FIG. 15 is a fragmentary vertical section taken on line 15—15 of FIG. 12.

FIG. 16 is a fragmentary vertical section taken on line 16—16 of FIG. 15.

FIG. 17 is a fragmentary horizontal section taken on line 17—17 of FIG. 12.

FIG. 18 is a horizontal section taken on line 18—18 of FIG. 12.

FIG. 18A is a fragmentary plan view with parts in section of lower film clamping jaws and associated elements.

FIG. 19 is a fragmentary plan view, partly broken away and partly in section, of lower film clamp jaws in closed film clamping relationship.

FIG. 19A is a fragmentary plan view of the same clamping jaws and associated operating elements.

DETAILED DESCRITPION

Figure 2:
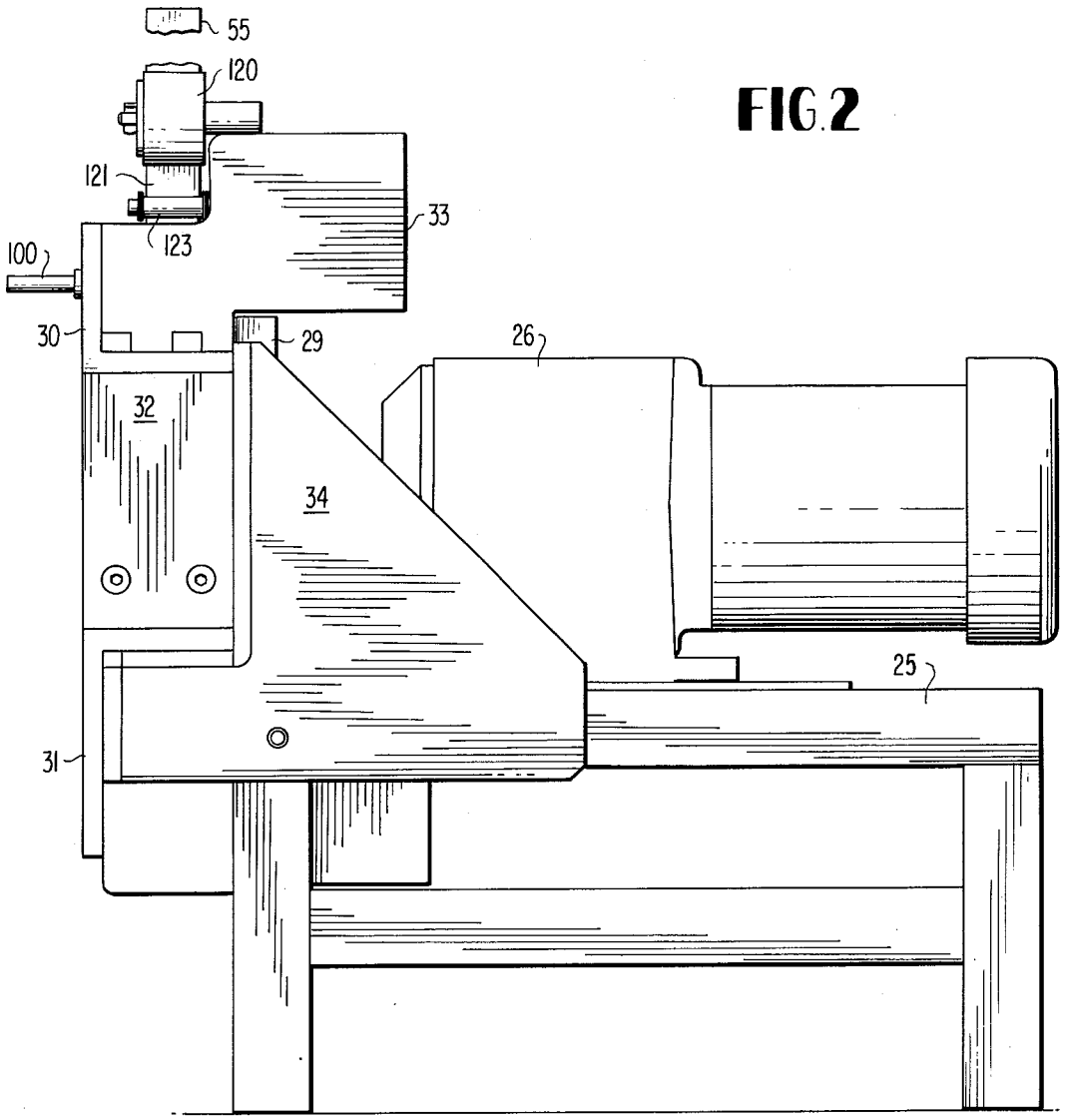
FIG. 2 is a side elevation thereof.

Referring to the drawings in detail wherein like numerals designate like parts throughout, a molding apparatus according to the invention embodies a stand 25 for the rigid support of a horizontal axis gear motor 26 such as a Reliance Electric 30 rpm one-half h.p. gear motor No. TG16A or equivalent drive means. The horizontal shaft 27 of gear motor 26 is coupled through a flange 28 with a cam plate 29 and drives this cam plate in a vertical plane. As will be described, all movements of the molding apparatus are derived from the single rotating cam plate driven by the gear motor 26.

In addition to the frame 25, the support means for the apparatus comprises an upper rail 30 in the form of a sturdy angle bar and a lower rail 31 also of angle form. Side posts 32 separate the two support rails 30 and 31 in fixed relationship. An upper enclosure for parts yet to be described is formed in part by spaced side walls 33 atop the rail 30, and side adapters 34 disposed rearwardly of the posts 32 and at the two sides of the frame 25 lend further rigidity to the support structure as well as enclosing the rotating cam plate 29 and its drive shaft 27.

Figure 12:
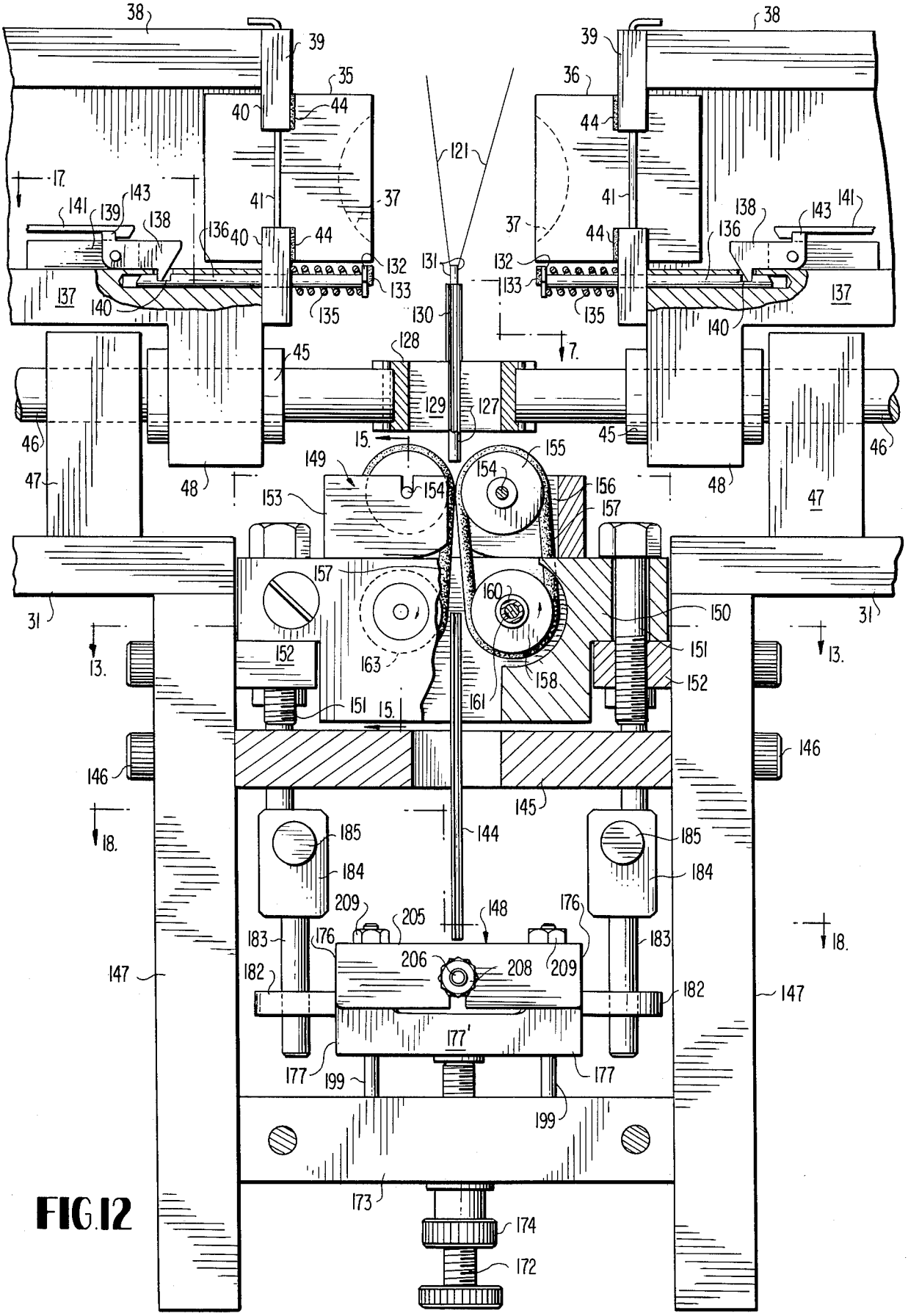
FIG. 12 is a vertical section taken on line 12—12 of FIG. 11.

More particularly, the molding apparatus comprises opposing mold halves or sections 35 and 36, each having a cavity 37, FIG. 12, of any preferred shape. In the embodiment illustrated, the mold halves are unheated and are not provided with an ejection means for the molded product. In some cases, conventional heating means and product ejection means may be provided within the scope of the invention. The mold halves 35 and 36 are of rectangular block-like form and are secured to a pair of slides 38 for movement therewith by means of end plates 39 fixed to the inner ends of the slides and engaging within grooves 40 formed across the tops and bottoms of the mold halves 35 and 36. The mold halves are locked to the end plates 39 against lateral displacement by means of gravity pins 41 which are readily removable.

Figure 1:
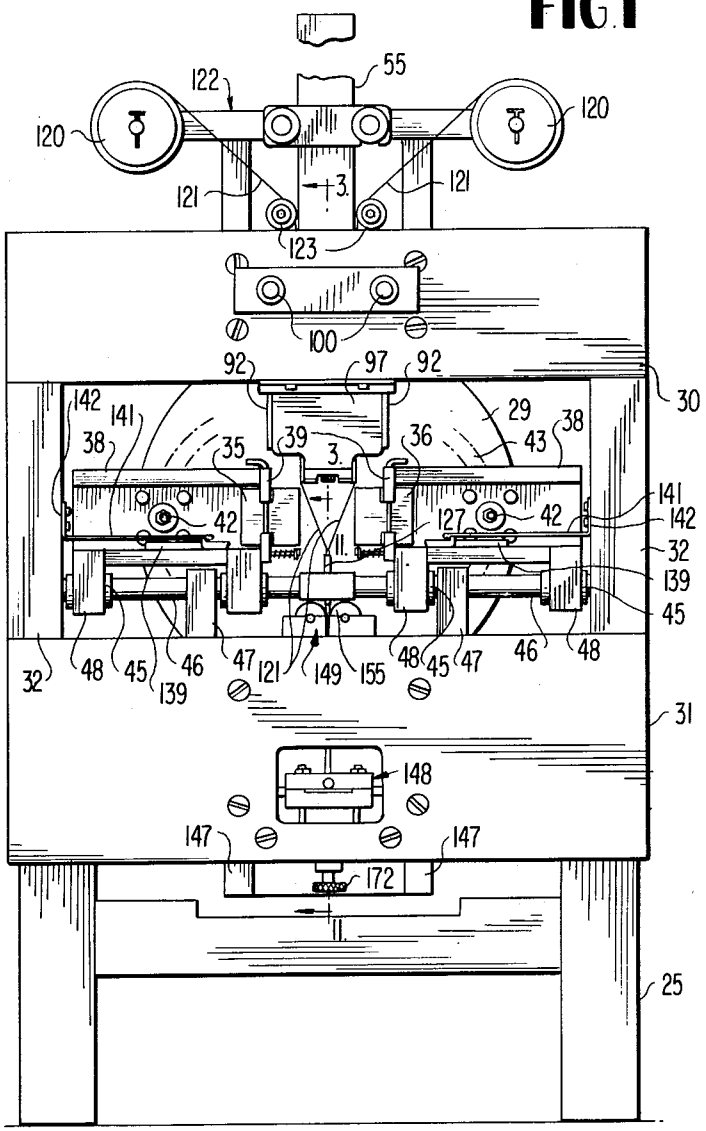
FIG. 1 is a front elevation of the apparatus.

The slides 38 are channel-like in cross section and open at their forward sides, FIG. 1. They are equipped on their rear sides with cam followers 42, FIGS. 1 and 17, which engage in an endless follower groove 43 formed in the front face of cam plate 29. The groove 43 is formed on a modified sinusoidal curve with respect to the angular position around the center of the cam plate. By virtue of this, the slides 38 carrying the mold halves travel with non-linear accelerations. The slides are always moving in opposite directions to each other on linear paths and they move away from each other following a molding operation at a much greater rate then they move together to perform a molding operation. The profile of the groove 43 is designed to provide maximum compressive force behind the mold halves 35 and 36 as the latter slowly move together to compress and mold the product stock.

A feature of the simplified reciprocating mold halves is the provision on the inner side of each end plate 39 of an elastomer strip 44, such strip facing and abutting the near side of the groove 40 in each mold half. By virtue of this arrangement, the two mold halves 35 and 36 may move together with a slight interference during the molding process and the elastomer strips will yield slightly under pressure. This avoids the necessity for hand fitting the mold halves so that they will close precisely, thus avoiding a costly procedure in manufacturing.

The slides 38 are mounted through ball bushings 45 on hardened ground steel shafts 46 held within standards 47 on top of the lower rail 31. The ball bushings 45 are held fixedly in arms 48 which depend from the bases of slides 38. This mounting of the slides carrying the two mold halves is very stable and provides accuracy and repeatability with minimized friction and wear, and with considerably less cost than what would be involved with machined ways.

A very important aspect of the invention shown particularly in drawing FIGS. 3 through 10 is the provision of means for charging the mold cavity with properly sized moldable stock pieces during each molding cycle and for advancing the moldable stock downwardly in the stock magazine so that another piece of stock may be severed near the bottom of the magazine for charging the mold on the next operating cycle. More particularly, a carrier 49 for mold charging and stock advancing means derives vertical movement from a second groove 50 in the forward face of cam plate 29 arranged inside of the endless groove 43 which generates the movements of the two mold halves 35 and 36. A cam follower 51 on the back of carrier 49 engages within the endless groove 50, which is profiled to impart the proper directions and rates of movement to the carrier in timed relationship with the movements of the mold halves 35 and 36 to achieve the desired results. The carrier 49 is guided in its vertical movement by ball bushings 52 held in the horizontal web of rail 30, such bushings receiving upstanding guide rods 53 fixedly secured to a top forwardly projecting flange 54 of the carrier 49.

Figure 5:
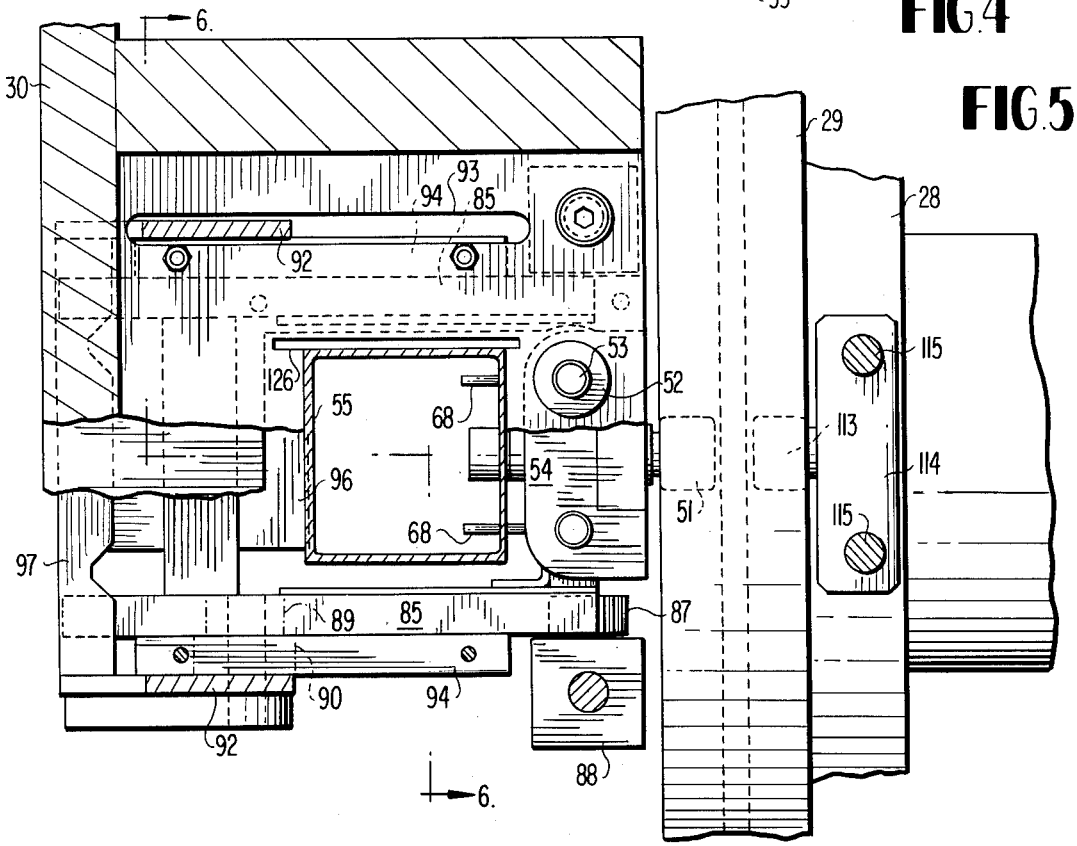
FIG. 5 is a horizontal section, partly broken away, taken on line 5—5 of FIG. 3.
Figure 6:
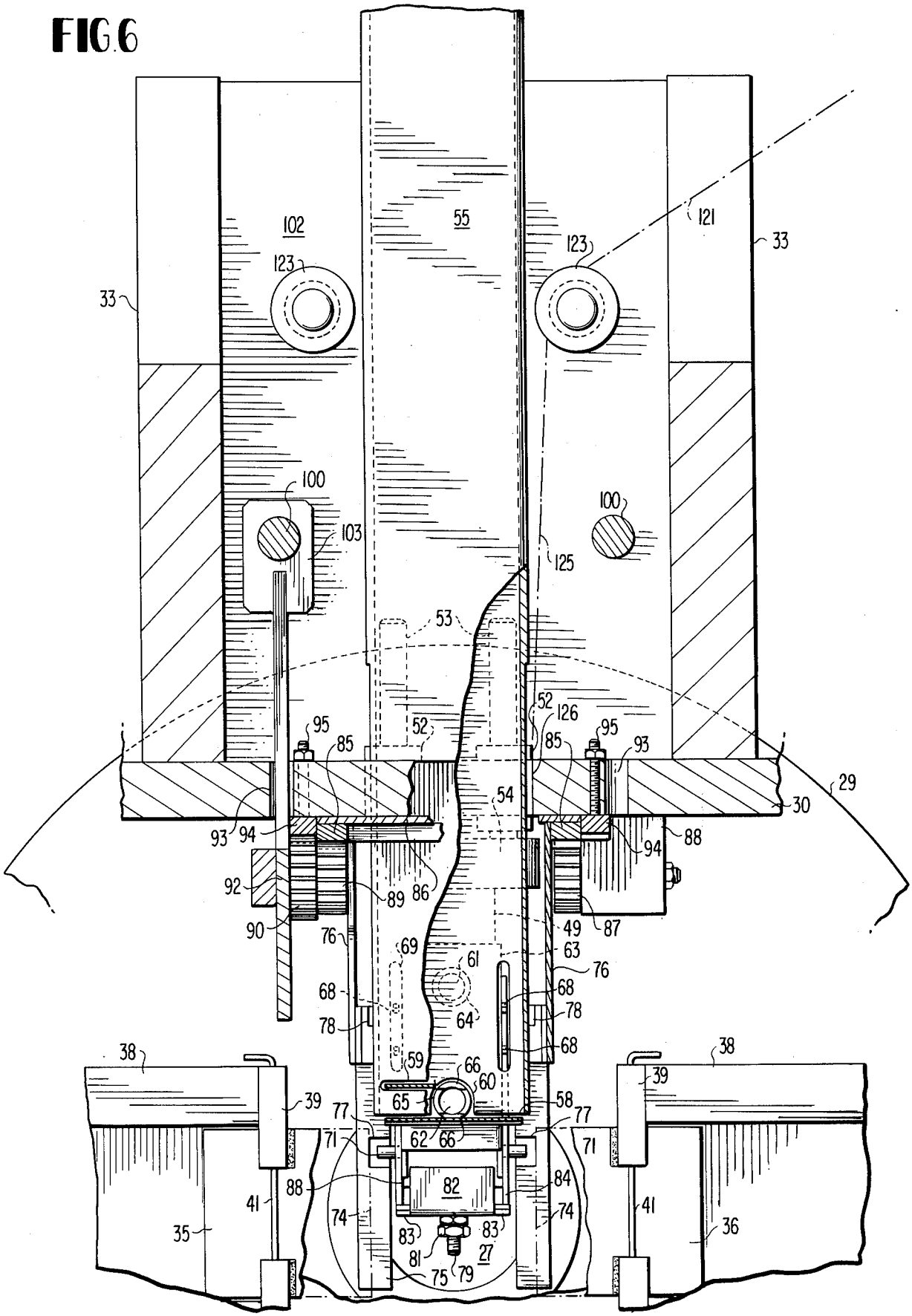
FIG. 6 is a vertical section taken on line 6—6 of FIG. 5.
Figure 7:
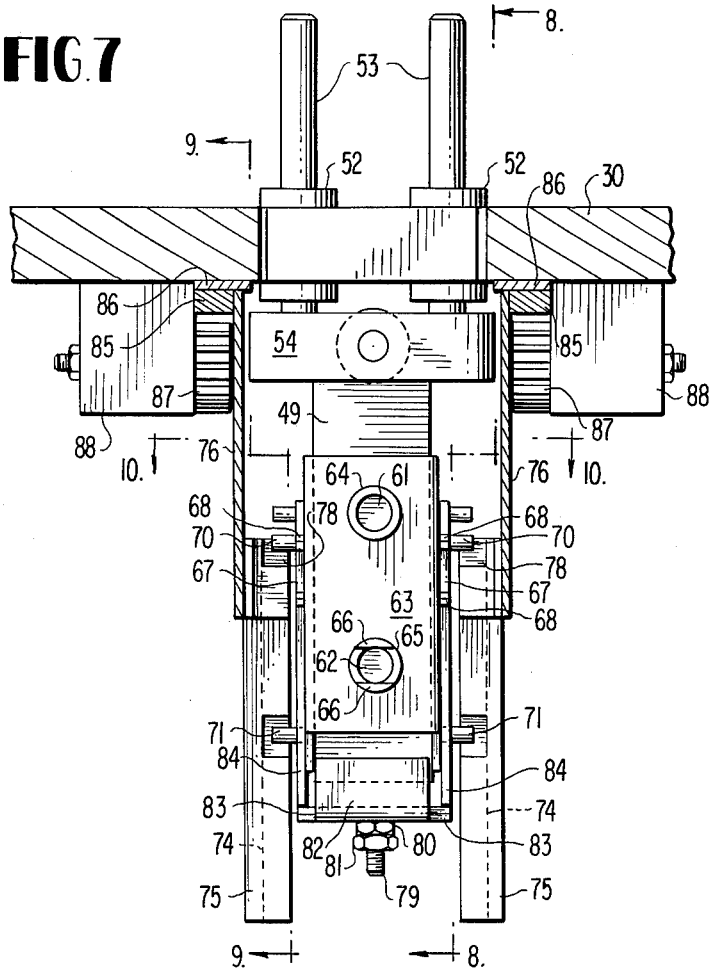
FIG. 7 is a fragmentary vertical section taken on line 7—7 of FIG. 3.
Figure 8:
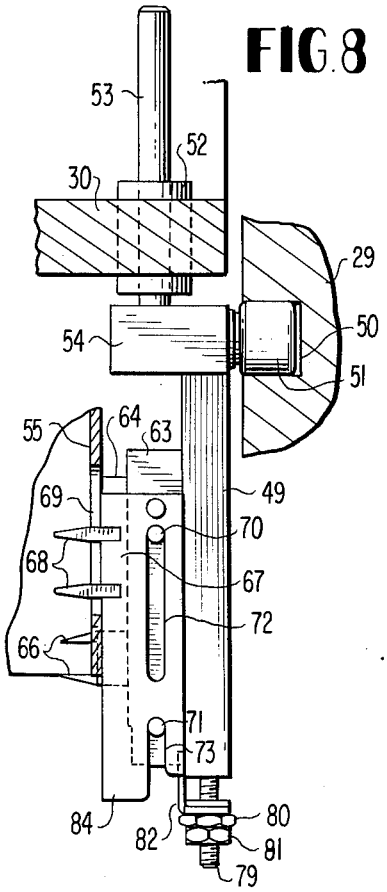
FIG. 8 is a vertical section taken on line 8—8 of FIG. 7.
Figure 9:
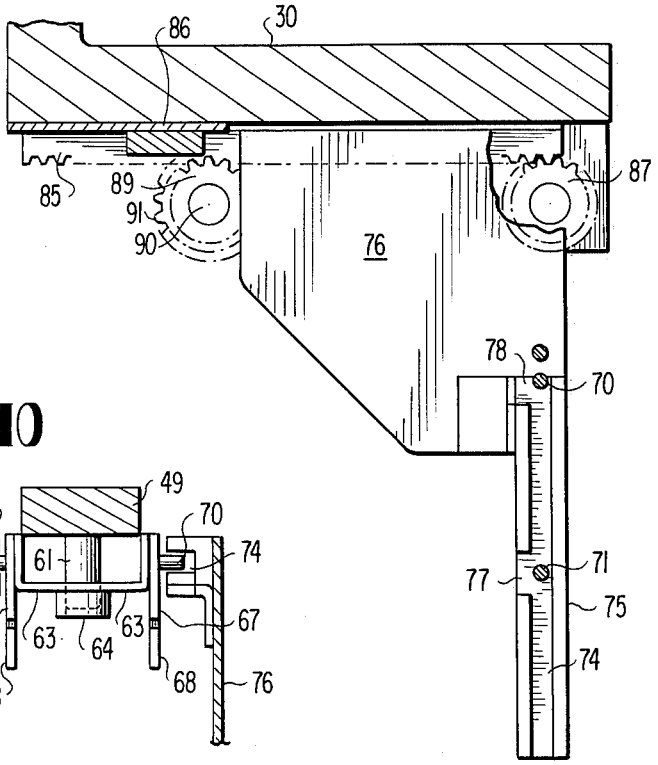
FIG. 9 is a vertical section taken on line 9—9 of FIG. 7.
Figure 10:
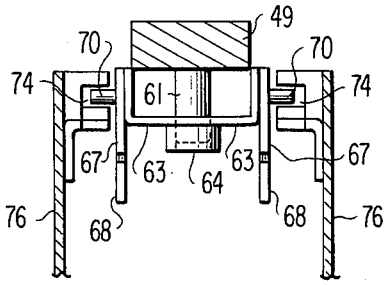
FIG. 10 is a horizontal section taken on line 10—10 of FIG. 7.

An elongated vertical fixed magazine 55 for moldable stock of the types mentioned in the form of a rectangular cross section tube is provided. As shown in FIGS. 1 and 2, this magazine can project well above the top of the upper rail 30 and it extends downwardly through a clearance opening 56 in the horizontal web of rail 30. Within this opening and below the rail 30, the wall thickness of magazine 55 is reduced, see FIGS. 4 and 5, and this provides a pair of opposite side shoulders 57 on the magazine which rests solidly on the horizontal web of rail 30, FIGS. 3 and 4. The lower end 58 of the magazine 55 terminates close to but slightly above the tops of mold halves 35 and 36. The forward wall of the magazine 55 has a horizontal slot 59 somewhat above its lower end 58 through which a stock cut off knife, to be described, may reciprocate horizontally. The opposing rear wall of the magazine has a central recess 60 or notch to receive a movable mold charging means, yet to be described, and this notch 60 opens through the lower end of the magazine as shown in FIG. 6.

The carrier 49 supports a vertically spaced pair of fixed horizontal guide pins 61 and 62 on which the vertically extending channel-shaped support element 63 is suspended by a pair of short horizontal sleeves 64 and 65 fixed on the forward side of the member 63. The lower sleeve 65 has forwardly projecting vertically spaced tines or fingers 66, between which a severed piece of stock at the bottom of the magazine 55 may engage and be delivered downwardly to the vertical center of the mold cavity for charging the mold, as will be further described. Coordinated with this mold charging operation is a stock advancing means in the form of a pair of laterally spaced feed dogs 67 having vertically spaced stock penetrating prongs 68 thereon. The prongs 68 project through parallel vertical slots 69, FIG. 6, formed in the rear side wall of the magazine 55 and the prongs are able to move vertically through the slots when advancing the stock downwardly in the magazine. The two feed dogs 67 lie at opposite sides of the channel member 63 and are of flat plate construction, and extend downwardly to elevations below the lower end of the member 63 as can be discerned in FIGS. 7 and 8.

The member 63 has horizontally projecting pins 70 and 71 on its opposite sides which pass slidably through vertical slots 72 and 73 of the feed dogs 67 and into vertical guide slots 74 of a pair of laterally spaced depending vertical arms 75 which are attached to spaced side plates 76 of an advance-retract mechanism to be fully described and forming an important and unique feature of the invention. It may be mentioned that the vertical slots or passages 74 in arms 75 have lateral entrances 77 and 78 which are employed only in the initial assembly of parts, and have no function in the operation of the apparatus during a molding cycle.

Due to the engagement of the projecting pins 70 and 71 on the channel member 63 through the slots 72 and 73 of the feed dogs 67, it can be seen that there is relative movement vertically between the mold charging fingers 66 and the stock advancing prongs 68 when these elements are raised and lowered by movement of the carrier 49. This will be further described. An adjustment for the stock feed means is provided in the form of a threaded stub 79 dependingly mounted on the lower end of carrier 49 supporting adjusting and locking nuts 80 and 81 which underlie an adjustable feed dog lifting bracket 82 having extensions 83 directly under the lower ends of the feed dogs 67, whereby the latter may be elevated relative to the member 63. The bracket 82 is attached fixedly to the forward side of carrier 49 at the lower end of the carrier. In connection with the above, it should be noted that each feed dog 67 has a lower extension 84, FIG. 8, which is positioned above lift extensions 83 when the feed dogs are retracted at the rear of the magazine 55 toward the cam plate 29. It is at this time that the lift extensions 83 catch and lift the feed dogs 67 during upward movement of the carrier 49, and after some lost motion between the feed dogs and the member 63 due to the arrangement of the slots 72 and 73. With the parts arranged as in FIG. 3 and in FIG. 8, the two feed dogs 67 are in fact hanging by gravity on the two pins 70 and 71 of channel member 63, the latter being supported at all times on the pins 61 and 62. There is relative or lost motion between the feed dogs and the member 63 during both downward and upward movement of the carrier 49.

The previously-mentioned advance-retract mechanism which is vital to the mold charging and stock advance operations further embodies a pair of spaced parallel horizontally movable racks 85 attached fixedly to the side plates 76 with their tops slidably engaging bearing plates 86 attached to the lower face of rail 30. The movable racks 85 are supported at their rear ends by idler gears 87 suspended on fixed mounts 88 from the rail 30. The movable racks are driven at points well forwardly of the idler gears 87, FIG. 9, by drive gears 89 brazed to the inner sides of larger diameter gears 90 which rotate with the smaller movable rack driving gears as a unit on a support shaft 91 secured to an adjacent vertical plate 92 which reciprocates horizontally within a slot 93 provided in the horizontal web of rail 30. It will be understood that there are two slots 93 in the rail 30, FIG. 6, and two plates 92 operating through these slots and projecting above and below the rail. Below the rail, each plate 92 carries a set of the connected gears 89 and 90 which can rotate as a unit, each smaller gear 89 driving one of the horizontally movable racks 85.

The larger gear 90 of each attache set engages a fixed horizontal rack 94 on the bottom of the rail 30 and secured thereto by threaded means 95 or by other suitable means. As the plates 92 are caused to move horizontally by a rocker plate linkage, yet to be described, the larger gears 90 roll on the fixed racks 94 and cause the smaller gears 89 to revolve and to also drive the movable racks 85. The movable racks will be moved toward the cam plate 29 by a distance equal to the difference in distances traveled by the peripheries of the two gears 90 and 89. The net result of this is that there will be a differential movement between the mold charging finger elements 66 and the stock advancing prongs 68 relative to a stock cut off knife 96 which is directly attached to plates 92 through a knife support 97. By virtue of this differential movement of elements 66 and 68 relative to the knife 96 horizontally, the knife 96 will always have severed the stock in the magazine 55 completely and will have returned to the position shown in FIG. 3 by the time the elements 66 and 68 have arrived at their active positions shown in FIG. 3 ready for another charging of the mold and another advance downwardly of the stock in the magazine 55. In accomplishing this by means of the described differential rack and pinion means, the elements 66 and 68 travel horizontally in the same directions as the plates 92 and knife 96 but at different speeds.

Also carried by the support or base 97 for the stock cutting knife 96 is a stock supporting blade 98 spaced somewhat below the knife and adjacent to the bottom end 58 of the magazine. The support blade 98 and knife are secured detachably to the element 97 by thumb screw means 99, as illustrated. When the knife 96 enters the magazine 55 to cut off a piece of stock so that the latter can be engaged by the mold charging fingers 66 and delivered downwardly to the center of the mold cavity, the blade 98 passes beneath the lower end of the magazine and serves as a support for the severed piece of stock until the elements 96 and 98 return to their positions shown in FIG. 3.

The horizontal movements of the plates 92 which support the knife 96 are derived from a pair of horizontal shifter rods 100 engaging through ball bushings 101 supported on the rail 30 and a rearward vertical plate 102 between the side walls 33. Blocks 103 carrying the plates 92 are secured as at 104 to the shifter rods 100 to reciprocate therewith. An upper rocker plate 105 of generally triangular form is pivotally suspended from a pin 106 attached to an anchor 107 which depends from an overhead horizontal support plate 108 between the side walls 33. The rocker plate has a lower slot 109 slidably receiving a cross pin 110 attached to head blocks 111 on opposite sides of the rocker plate 105 to thereby convert rocking movement of the rocker plate into linear horizontal movement of the rods 100 and the parts carried thereby.

Figure 3:
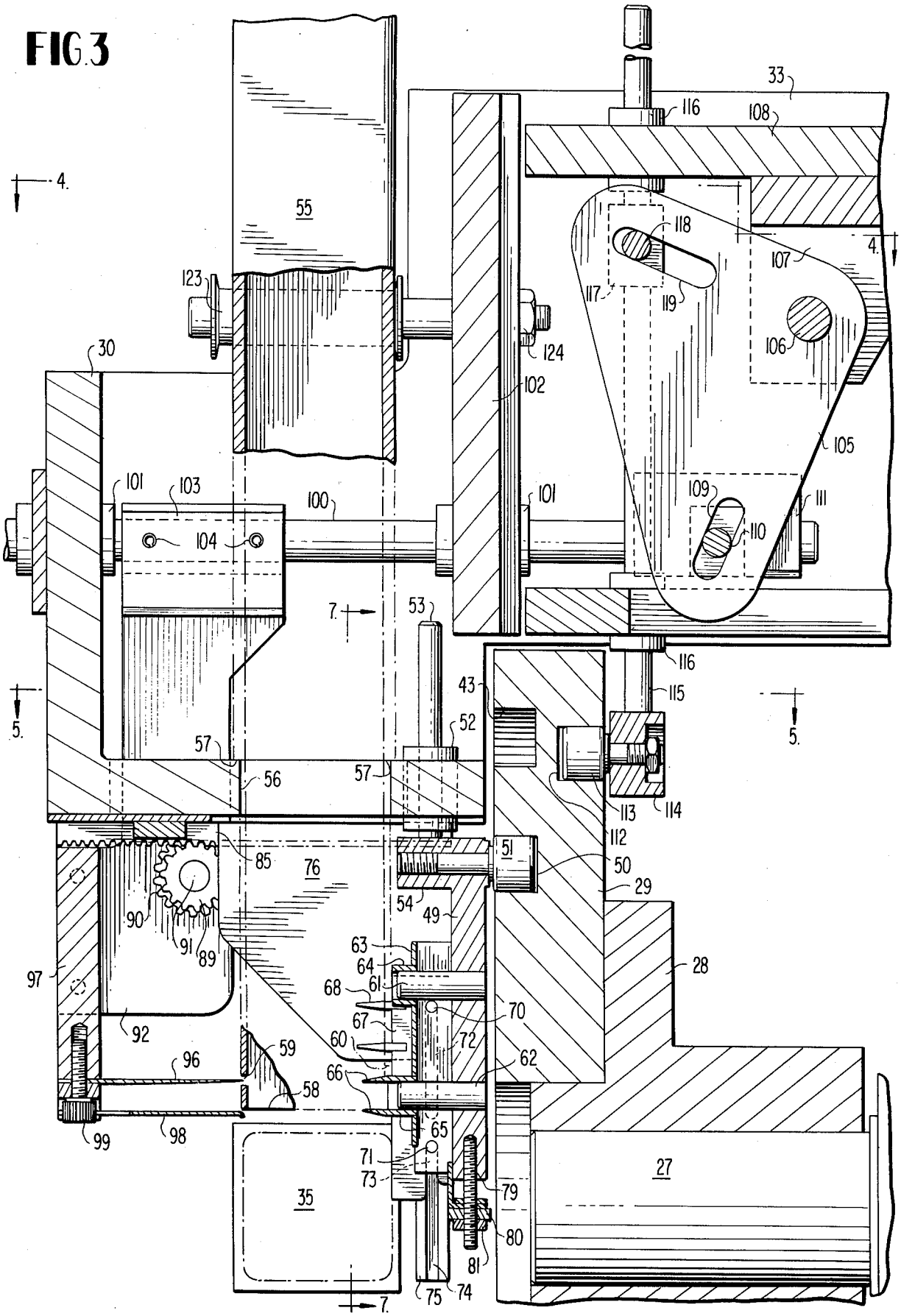
FIG. 3 is an enlarged fragmentary vertical section taken on line 3—3 of FIG. 1.
Figure 4:
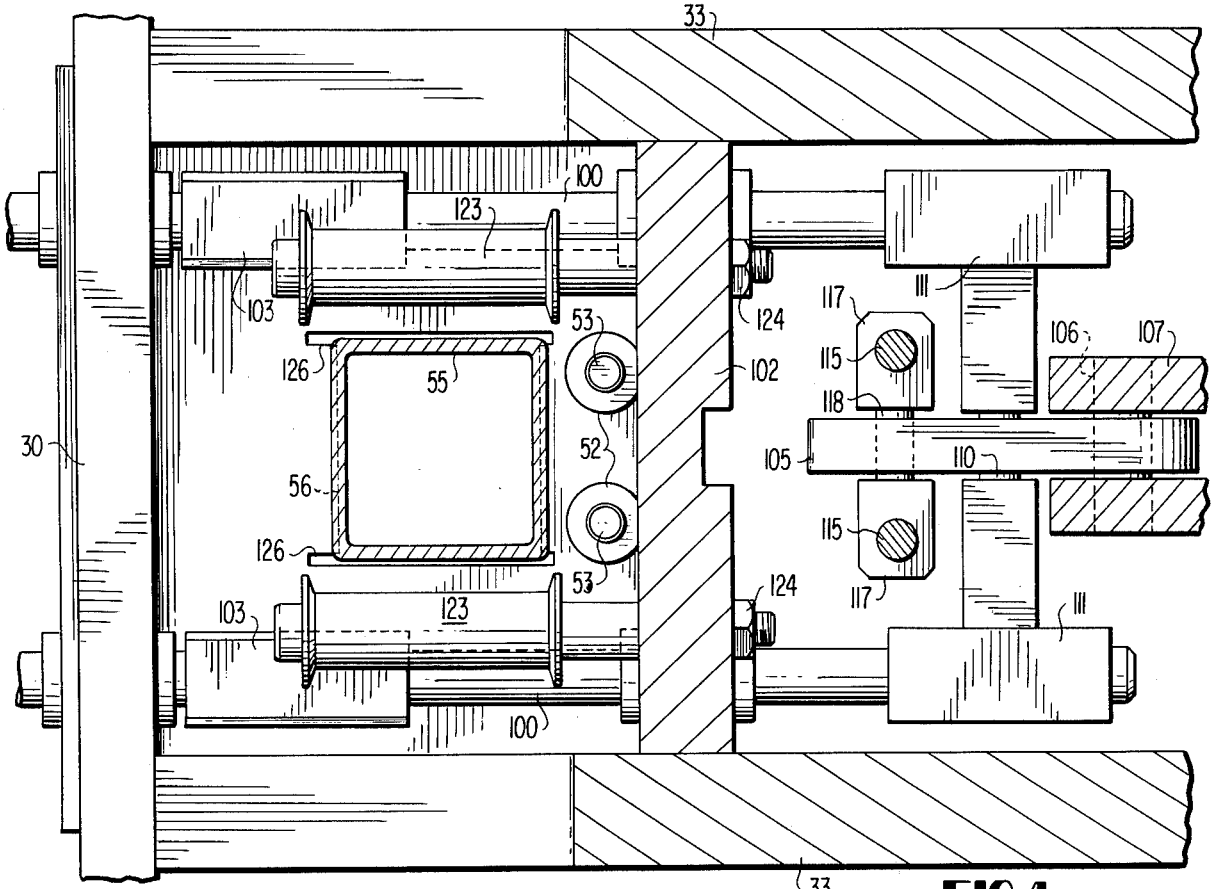
FIG. 4 is a horizontal section taken on line 4—4 of FIG. 1.

The cam plate 29 has a further groove 112 on its rear face receiving a cam follower 113 attached to a crosshead 114 at the rear of the cam plate. The crosshead 114 is secured rigidly to parallel vertical shifter rods 115 which are guided in their movements by ball bushings 116 as shown in FIG. 3. The rods 115 have attached heads 117 below the upper ball bushings 116 on opposite sides of the rocker plate 105, and these heads carry a cross pin 118 which engages through a slot 119 in the rocker plate. It can be seen that rotation of the cam plate 29 will cause vertical reciprocation of the rods 115 and turning of the rocker plate 105 in one direction or the other on its pivot 106 to advance or retract the rods 100 carrying the plates 92, gears 89 and 90 and knife 96, as previously described. Therefore, rotational motion of the cam plate 29 is converted into linear reciprocation of the knife 96 and associated parts through a simple and sturdy mechanism.

The advance-retract mechanism which has not been essentially described functions to produce simultaneous movements and also relative movements of the stock cut-off knife 96 and support blade 98 and the charging finger elements 66 and stock advance prongs 68 horizontally. It has been shown that rotation of the cam plate 29 results in horizontal linear movement of the plates 92, knife 96 and other parts mounted on the plates 92. This includes the connected pairs of pinions 90 and 89 which respectively engage stationary racks 94 and horizontally movable racks 85. Due to the difference in diameter between the gears 89 and 90, the movable racks 85 will travel forwardly or rearwardly with the knife 96 and associated parts but at a differential rate. The movable racks 85, being connected with side plates 76 and these plates being in turn connected to the vertical arms 75, transmit their horizontal movements to these elements. Since the lateral pins 70 and 71 of channel member 63 are held captive in the grooves 74 of arms 75, horizontal movement of these arms will produce the same movement in the elements 63 and 67, together with the elements 66 and 68 which are joined to member 63 and feed dogs 67, respectively. Therefore, these elements 66 and 68 will move horizontally forwardly or rearwardly relative to the fixed magazine 55 whenever there is movement of the racks 85 and movement of the knife 96 and associated parts. The member 63 and feed dogs 67 are able to shift horizontally on the pins 61 and 62 and are able to straddle the sides of the carrier 49, FIG. 10, which cannot move horizontally and only moves vertically responsive to cam plate rotation.

It has already been described in connection with the vertical movement of carrier 49 upwardly or downwardly that there is lost motion or relative movement between the channel member 63 and feed dogs 67. In the downward movement of the carrier 49, the member 63 and charging fingers 66 will move with the carrier but the prongs 68 still being engaged with the stock through magazine slots 69 will lag and downward movement of the feed dogs 67 will not occur until the flange 54 engages the tops of the lagging feed dogs 67, FIGS. 7 and 8, and drives them downwardly to advance the stock, such downward movement being limited by engagement of the lower prongs 68 with the lower ends of the magazine slots 69. On the reverse or upward movement of the carrier 49, the feed dogs 67 will also lag under influence of gravity and due to the provision of slots 72 and 73 in the feed dogs, the member 63 will initially rise without the feed dog. However, when the adjustable height lift elements 83 catch the lower ends of the feed dogs, as described, they will be elevated and the vertical adjustability of the lift elements 83 will determine when the feed dogs begin to move upwardly with the carrier 49, and hence how far up the prongs 68 will be positioned when the carrier is at the top of its travel. Therefore, the adjusting means 70–80 enables the extent of stock advance to be regulated so that a larger or smaller stock piece can be cut off by the knife 96 and delivered to the mold cavity by finger elements 66.

As described thus far, the operation of the molding apparatus can be briefly summarized in terms of the following sequence of steps:

1. The knife 96 advances through the stock in the magazine 55 and cuts off a piece of stock which will be supported on the blade 98, and the knife starts retracting toward its inactive position of FIG. 3.

2. Finger elements 66 start advancing into the stock while the knife 96 is being retracted and the feed dogs 67 with their prongs 68 are advanced horizontally into the stock in magazine 55 at the same time.

3. When the knife 96 has fully returned to its position in FIG. 3, finger elements 66 and feed dog prongs 68 will have reached their full forward positions, as shown in FIG. 3, and the elements 66 start moving downwardly with the carrier 49 toward the vertical center of the mold cavity. The previously cut off piece of stock is carried downwardly by the finger elements 66 at this time. There is a lag or lost motion in the prongs 68 of the feed dogs 67 and the prongs 68 do not start to advance the stock downwardly in the magazine 55 until the feed dogs are engaged by the descending flange 54 and are driven donwardly with the stock by this flange. As described, the downward stock advance is limited by the bottom terminals of the magazine slots 69.

4. The two mold halves 35 and 36 begin moving inwardly toward the piece of stock to be molded. When they have moved inwardly sufficiently to begin forming the piece of stock, the finger elements 66 begin their retraction toward the cam plate 29, FIG. 3, while the mold halves continue to close on the piece of stock for molding it. Simultaneously, the knife 96 is moving forwardly into the stock and cutting off another piece of stock.

5. Just prior to the complete retraction of finger elements 66 toward the cam plate 29, these elements begin their upward vertical movement with the carrier 49 toward their position for the start of step (2) above.

6. After the mold halves 35 have come together slowly and with maximum power to mold a product unit, they separate quickly for the beginning of a new operating cycle. At the beginning of each cycle, the elements 66 and 68 are at their topmost and rearmost positions relative to the magazine 55. The mold halves 35 and 36 are fully retracted or separated. The knife 96 and stock support blade 98 are also in their rearmost positions toward the cam plate 29.

The molding apparatus additionally embodies a molded product packaging or encapsulating material handling and cut off system, and this system is primarily illustrated by drawing FIGS. 11 through 19A. It should be mentioned that in some cases the apparatus may be employed without an encapsulating material or film and in these cases the handling and cut-off system could be eliminated entirely. For example, it is thought that the molding apparatus as described thus far in connection with FIGS. 1 through 10 could be employed to mold butter or the like without encapsulating material and without the handling and cut off system of FIGS. 11 through 19A. In such a case, the mold halves 35 and 36 would contain conventional electric heaters and would have a product ejector means communicating with each cavity 37. Preferably and for most molding applications, the apparatus will embody the already-described mechanisms plus the closely associated handling and cut-off system for encapsulating film or the like, now to be described in detail.

Figure 11:
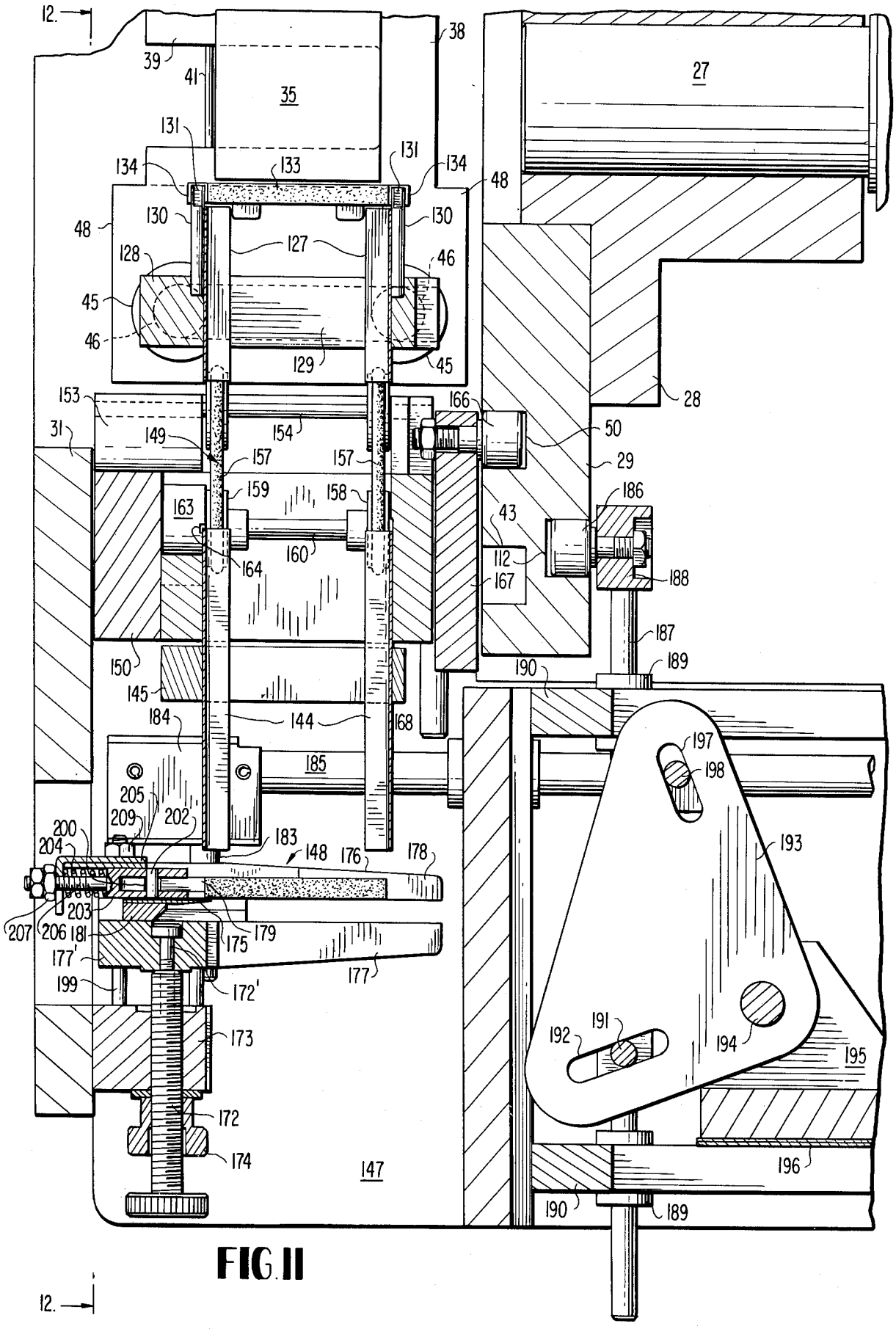
FIG. 11 is a vertical section taken on line 11—11 of FIG. 1.

In FIGS. 11 and 12, it can be observed that the above-noted film handling and cut-off system is arranged below the horizontally reciprocating slides 38 and mold halves 35 and 36. This disposition of the system below the level of the mold halves is also apparent in FIG. 1.

Supply rolls 120 for encapsulating film webs 121 are supported above the upper rail 30 of the apparatus on support structure 122, FIG. 1. While different types of film can be utilized including heat sealable films, the system being described utilizes a thin clear plastic film of the type which is self-adherent to another film section under an applied pressure of about 50 psi. No adhesive is required for adhering the two webs of film together around a molded product unit. One well known commerical film of this type is widely marketed under the registered trademark SARAN WRAP. Other similar types of films are available on the market.

Slightly below the supply rolls 120 and just above rail 30, a pair of laterally spaced horizontal axis film guide rolls 123, or spools, are supported on the adjacent wall 102 as indicated at 124. The film webs 121 engage the inner sides of these guide rolls 123 and extend downwardly therefrom on generally vertical paths 125, FIG. 6, and pass through film slots 126, FIGS. 4 and 5, formed through the horizontal web of rail 30. As shown in FIGS. 5 and 6, the undercut walls of magazine 55 allow clearance for the film webs 121 to pass through the slots 126 freely.

Below the slots 126 the two film webs 121 follow the sides of magazine 55 down to the level of the mold halves 35 and 36 as approximately illustrated in FIGS. 1 and 12. As previously noted, the major components of the film handling and cutting system are below the mold halves.

More particularly, a stationary upper vertical film guide for the two webs 121 is formed by a pair of spaced opposing vertical U-channels 127 securely held on a base member 128 which is rigidly connected to and supported by the interior ends of the horizontal shafts 46 on which the slides 38 operate. The base member 128 has a large central opening 129 through which the film webs may pass during guidance by the U-channels 127. The tops of the U-channels 127 are disposed slightly below the bottoms of the mold halves 35 and 36. Stops 130 for an upper film clamp, to be described, are brazed to the backs of U-channels 127 and project slightly thereabove and have opposite side flat faces 131 in the paths of movement of the upper film clamp sections to assure that these clamp sections will meet exactly at the center of the apparatus.

The upper film clamp, FIGS. 12 and 17, comprises opposing horizontally movable clamp sections or bars 132 having elastomer strips 133 on their forward faces to engage and grip the film webs 121 immediately above the tops of U-channels 127 and at the vertical center line of the apparatus. End extensions 134 of the clamp bars 132 contact the flat top faces 131 for automatically exactly centering the upper film clamp when it is holding the film without the necessity of employing perfectly matched springs or other parts of the apparatus, thus reducing cost without reducing efficiency of operation.

The clamp sections 132 are biased by springs 135 toward their active film clamping positions. The springs 135 surround spaced parallel support and guide rods 136 for the clamp sections 132, which rods reciprocate horizontally through provided openings in the end plates 39 and the bases 137 of slides 38, see FIGS. 12 and 17. THe springs 135 have their ends bearing on the backs of clamp sections 132 and on the opposing faces of end plates 39. Gravity biased pairs of retrievers 138 are pivotally attached to opposite sides of retriever mounts 139, in turn fixedly secured to the bases 137 of slides 38. THe noses of the retrievers 138, FIG. 12, are adapted to enter notches 140 formed in rods 136 so that the retrievers can releasably latch the upper film clamp sections 132 in their retracted positions shown in FIG. 12.

Coacting pawls 141 have their outer ends 142 fixed to the posts 32 as illustrated in FIG. 1. The pawls engage with upstanding lugs 143 on the pivoted retrievers and when the slides 38 move toward the center of the apparatus for molding, the retrievers 138 move with them and the pawls 141 turn the retrievers upwardly on their pivots and release the rods 136, so that the springs 135 may thrust the upper clamp sections 132 into gripping engagement with the film webs 120 at the exact center of the apparatus, as explained, before the inward movement of the mold halves with their slides 38 is complete.

As the mold halves 35 and 36 meet on the charge, the elastomer strips 44 compress slightly. The pivoted retrievers will drop into the notches 140 and as the mold halves begin their retraction toward the positions of FIG. 12, the clamp sections 132 will move back with them. Upon reaching the free ends of pawls 141, such ends will simply ride over the lugs 143 and assume the engaged positions with the retrievers shown in the drawings, whereby on the next closing of the mold halves on the charge, the retrievers 138 will be released from the rods 136, as described above.

Below the upper film guide composed of U-channels 127 and aligned therewith vertically is a lower fixed film guide composed of U-channels 144, the latter being fixedly held in a support or base 145 attached at 146 to spaced vertical support walls 147 of the apparatus frame. Immediately below the lower ends of U-channels 144 constituting the lower film guide is a vertically adjustable lower film clamp and cut-off assembly 148, which will be described in detail. Between the upper and lower film guides, FIGS. 11 and 12, is a cyclically operated film advance assembly 149 which will next be described. This assembly advances the film webs 121 downwardly as the mold charging fingers 66 move downwardly, and the downward travel of the film stops at the same time as the elements 66 stop at the vertical center line through the mold halves 35 ad 36.

The film advance assembly 149 includes a mounting base or body 150 secured by bolts 151 to underlying fixed rests 152 supported on the walls 147. The assembly 149 further includes a pillow block 153 atop the mounting base 150 and secured thereto fixedly and constituting the support for upper axles 154 of the film advance carrying attached pulleys 155. The pillow block 153 has a large central opening 156 formed therethrough to accommodate the pulleys 155 and pairs of O-ring film drive belts 157 which are trained over the pulleys 155 and extend downwardly in vertical planes with their inner opposed peripheral portions in film gripping and driving relationship under some compression, FIG. 12. The blets 157 also engage pulleys 158 and 159 of lower tubular shafts 160 with which they are integrally joined, FIG. 15. The lower tubular shafts receive through them internal rotary shafts 161 which carry drive pinions 162 at corresponding ends and which are actively connected with conventional one-way free wheeling and one-way active miniclutches 163 at their opposite ends. The clutches 163 connected with the two lower shafts 161 are identical and conventional, although one of the clutches is active or power transmitting in the opposite rotational direction from the other clutch 163. The clutches 163 are mounted on and substantially enclosed within the mounting base 150, as shown. The one-way active rotational power transmitting heads of the clutches 163 are slotted at 164, FIG. 15, to receive drive lugs 165 on the adjacent pulleys 159, see FIG. 16.

In order to motivate the film advance belts 157 cyclically to advance the film in properly timed relationship with the mold halves and film clamps, another cam follower 166 attached to a vertically movable carrier 167 engages in the forward cam slot 50, previously described, whereby cam plate rotation will elevate and lower the carrier 167. The carrier is guided in its vertical movement by vertical rods 168 dependingly secured to wings 169 of the carrier, the rods 168 being guided in their movements by bearing elements 170 attached to the walls 147.

A pair of vertical racks 171 is fixedly mounted on the forward side of carrier 167 in driving relationship with the previously-noted pinions 162 on lower shafts 161. It can now be understood that as the carrier 167 rises and falls responsive to cam plate rotation, the attached racks 171 will turn the pinions 162 simultaneously and in opposite directions of rotation. These pinions, in turn, will rotate the two shafts 161 oppositely and the one-way active clutches 163 associated with the shafts 161 will drive the tubular shafts 160 in proper directions of rotation to motivate the blets 157 cyclically in the proper directions, FIG. 12, to advance the film webs 121 downwardly as required. Since the clutches 163 are free wheeling in one direction, the O-ring belts 157 will be driven in the proper direction for one direction of movement only of the carrier 167, and the shafts 160 will not be driven in the other direction of movement of the carrier because the clutches 163 are not capable of turning the shafts 160 at that time.

The lower film clamp and cut-off assembly 148 is positioned immediately below the lower film guide U-channels 144 and is bodily adjustable vertically by means of a manual adjusting screw 172 having threaded engagement with a fixed cross member 173 secured to the walls 147. A locking nut 174 is provided to releasably lock the assembly 148 in a selected height adjusted position. The adjusting means enables the horizontally movable film cutting knife 175 of the assembly 148 to sever the film edgewise precisely midway between each pair of encapsulated molded product units.

The assembly 148 additionally comprises a rigid body member having spaced upper and lower arms 176 and 177, the upper arms 176 having rearwardly divergent faces 178. As shown in FIGS. 18 and 19, the arms 176 overlie the arms 177 and the pairs of arms are laterally spaced equidistantly from the U-channels 144 which lie at the center of the apparatus.

Lower film clamping arms 179, or sections, are provided between the arms 176 and at the elevation of these arms, FIG. 11, and the interior faces of the clamp arms 179 carry elastomer strips 180 which engage and clamp the film webs 121 at proper times below the U-channels 144 so that the webs can be properly cut by the knife 175. The clamp arms 179 are swingable horizontally between their separated positions shown in FIG. 18 where they contact the divergent stop faces 178 and their fully closed film clamping parallel positions shown in FIG. 19.

The film cutting knife 175 is secured removably to a carrier 181 immediately above the lower arms 177 and shiftable horizontally relative thereto toward and from the cam plate 29. The carrier 181 has side extensions 182 which apertured to receive vertical drive pins 183. The drive pins 183 are dependingly secured to heads 184 which are attached to horizontal shifter rods 185 to move therewith toward and away from the cam plate 29 at proper times. The horizontal movement of the vertical drive rods 183 with the shifter rods 185 causes the knife carrier 181 to travel horizontally, as described.

A cam follower 186 operating within the cam plate groove 112, FIG. 11, produces vertical movement of rods 187 dependingly attached to a crosshead 188 which is secured to the follower 186. The rods 187 reciprocate within ball bushings 189 held in fixed members or plates 190. The rods 187 carry and drive a cross pin 191 which engages through a slots 192 in a lower rocker plate 193, said rocker plate being pivotally mounted at 194 to a stationary anchor 195 on the plate 190 which may be shimmed for accuracy as at 196. The rocker plate 193 also has an upper slot 197 which receives a cross pin 198 connected with shifter rods 185. The construction including the rocker plate 193, rods 185 and 187, and pins 191 and 198 and associated elements is identical to the arrangement for the upper rocker plate 105 and associated parts shown and described in connection with FIGS. 3 and 4. The two rocker plates 105 and 193 are operated in unison by rotation of the cam plate 29 and through the respective followers 113 and 186. Thus, in connection with FIG. 11, rotation of the cam plate 29 by action of the vertical rods 187 and rocker plate 193 is converted into horizontal reciprocation of the shifter rods 185 and corresponding horizontal movement of the knife carrier 181 and knife. It was not previously mentioned, and should be mentioned, that the body which includes arms 176 and 177 when vertically adjusted by the screw 172 is accurately guided on vertical pins 199. These pins are fixed to the cross member 173 and rise therefrom. The apertured extensions 182 can also move vertically on the rods 183, FIG. 12. It should also be noted that a recessed screw 172' in the forward crossbar 177' connecting the arms 177 enters a threaded bore of the adjusting screw 172, FIG. 11, and secures the body including arms 176 and 177 against the adjusting screw.

Responsive to horizontal movements of the lower knife 175 and its carrier 181, the lower film clamp arms 179 are operated in the following manner. The arms 179 have notches 200 on their inner sides and adjacent to forward end knuckles 201. The notches 200 coact with a center horizontally shiftable short vertical pin 202 secured fixedly to a yoke 203 which is urged with the pin 202 toward the cam plate 29 by a spring 204. An L-bracket 205 overlies the yoke 203 and has its top web secured to the tops of arms 176 by nuts 209 carried by the top threaded ends of vertical pins 199. The spring 204 surrounds a threaded stus 206 projecting from the yoke 203 and attached thereto and being adjustable horizontally relative to the fixed bracket 205 by adjusting and locking nuts 207 and 208. By this means, the tension of the spring 204 may be adjusted.

A pair of laterally spaced vertical pins 210 attached to and rising from the knife carrier 181 and knife move horizontally with the knife relative to the lower film clamp arms 179 and along the outer faces of these clamp arms as depicted in FIGS. 18A and 19A. As shown therein, when the knife 195 is moved horizontally on its cutting stroke toward the cam plate 29, the pins 210 traveling with it cam the film clamp arms 179 toward their parallel active positions, and the pins 210 maintain the lower film clamp closed while the knife 175 is cleanly cutting the film edgewise midway between film encapsulated molded product units. It may be noted at this point that the pressure exerted on the film webs 121 by the leading faces of the mold halves 35 and 36 when the latter move together into contact causes the webs to permanently adhere to each other for encapsulating the molded charge or product unit.

When the knife 175 retracts away from cam plate 29, FIG. 18A, the two vertical pins 210 will eventually move beyond a dead center relationship with the relatively stationary spring-urged center pin 202, and the pins 210 will enter the knucles 201. This action causes the clamp arms 179 to open quickly when the knife 175 is near its forwardmost retracted position.

The operation of the encapsulating film guiding, advancing, clamping and severing system in FIGS. 11 through 19A can be summarized as follows.

Starting with the apparatus in the previously-described normal stopped position, the upper film clamp sections 132 are fully retracted with the slides 38 and mold halves 35 and 36, and the lower film clamp composed of arms 179 is closed as depicted in FIG. 19. As the mold charging fingers 66 move forwardly away from cam plate 29, the upper knife 96 ad lower knife 175 are being retracted away from cam plate 29. When the lower knife 175 is near its extreme forward position, FIG. 11, the two upstanding pins 210 projecting from its top cause the lower film clamp arms 179 to open quickly. As the mold charging fingers 66 move downwardly with the charge toward the center of the two mold halves, the film advance assembly 149 advances the film webs downwardly, and the downward movement of the film stops simultaneously with the downward travel of charging fingers 66. When the charging fingers and the film have stopped, the slides 38 have already begun moving toward the center molding position, and have moved approximately 1/10 inch each in that direction before the film and charger fingers 66 cease their downward movement. Immediately after the film stops moving, the pawls 141 catch the lugs 143 on the retrievers 138, rotating the retrievers upwardly and allowing the upper film clamp sections 132 to close, as described. The flat faces 131 on the stops 130 cause precise centering of the upper film clamp in an economical way without the need for matching springs or other associated parts.

The upper film clamp 132–132 then holds the film webs 121 smooth and flat across the center line of the apparatus while the mold halves 35 and 36 close and mold the charge which has been delivered by the charging fingers 56 to the vertical center of the mold and between the film webs 121. The upper film clamp 132–132 prevents the film from being pulled upwardly or laterally out of the film advance assembly 149 and maintains it in a smooth unwrinkled state across its full width so that the molded charge will be completely encapsulated between the film webs and the pressure exerted on the two webs by the front faces of the mold halves will cause the webs to adhere to each other firmly completely around the molded charge or product. As explained, for the type of film being employed, no heat sealing or adhesive material, such as a coating, is required.

Before the mold halves 35 and 36 close, the mold charging fingers 66 and the knives 96 and 175 move rearwardly toward the cam plate 29, the lower film clamp arms 179 close quickly, and the lower knife 175 then cuts horizontally across the film immediately below the lower clamp arms 179, see FIG. 11. As the mold closes on the charge, a small amount of film will be drawn down from the supply 120 and across the lower end of magazine 55. As the mold halves meet on the charge, the elastomer strips 44 compress slightly. The ends or noses of retrievers 138 drop into the notches 140, FIG. 12. The mold halves 35 and 36 then begin separating and retracting from the center position and the two sections 132 of the upper film clamp are retracted with them.

It may now be understood that the operations of all parts of the apparatus are initiated and fundamentally coordinated and timed by the single rotating cam plate 29. The coordinated components include the slides 38 and mold halves 35 and 36 thereon, the mold charging and stock advance means 66 and 68 and associated parts, the upper film clamp 132–132, the film advance unit 149, the upper and lower knives 96 and 175 and associated parts, and the lower film clamp means including the clamp arms 179. The intervening mechanisms between the rotating cam plate and these several major components are direct and positive in operation, sturdy, wear-resistant, and comparatively economical. Such intervening mechanisms between the rotating cam plate and these several major components are direct and positive in operation, sturdy, wear-resistant, and comparatively economical. Such intervening mechanisms include the parts which are moved vertically and horizontally on linear paths due to the activity of cam followers directly or through the described rocker plate linkages. The apparatus is characterized by high accuracy and consistency in its operation and compactness. Its many advantages over the prior art will now be appreciated by those skilled in the art.

In connection with the molding of foods by means of the apparatus, the preferably stainless steel parts which are readily removable for cleaning without tools are the mold halves 35 and 36, mold charger means 63–66, upper knife blade 96 and stock support 98, the magazine 55, and stock advance means 67–68.

Power to the gear motor 26 is interlocked with a limit switch, not shown, which will allow the apparatus to stop in only one position, as previously described. This is the position where the mold cycle ends and a new cycle begins. In this position, the slides 38 and mold halves are fully retracted from the center line of the apparatus and the mold charger and stock advance means 66 and 68, etc. are at the top and rearmost positions.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A molding apparatus comprising supporting means, a horizontal axis rotary cam plate on the supporting means, power drive means connected with said cam plate to rotate it at a predetermined speed of rotation, a pair of opposing simultaneously oppositely horizontally movable mold halves on the supporting means, cam follower means connected with the mold halves and said cam plate whereby the latter directly drives the mold halves, a vertical moldable stock magazine on the supporting means at the center of the apparatus in relation to an inward molding position of said mold halves, horizontal movement means on the supporting means including a knife to cut off pieces of stock in the magazine near the lower end thereof, mechanism on the supporting means for converting rotational movement of said cam plate into horizontal reciprocatory motion of said horizontal movement means and including a cam follower driven by said cam plate, a vertically movable carrier having guided engagement with the supporting means and including a cam follower driven by said cam plate, mold charging and stock advancing means on said carrier and being vertically movable therewith and also adapted to shift horizontally in opposite directions relative to said carrier, a horizontal movement connection between said mold charging and stock advancing means and said horizontal movement means whereby horizontal movements of the latter can cause corresponding movements of the former in the same directions of movement but at different speeds and for different distances, and said horizontal movement means including differential drive means for said mold charging and stock advancing means.

2. A molding apparatus as defined in claim 1, and slides carrying said mold halves demountably, and horizontal guideway means for said slides on said supporting means.

3. A molding apparatus as defined in claim 1, and said rotary cam plate having a first cam groove in its forward face receiving the cam follower means connected with the mold halves, the mold halves disposed forwardly of said cam plate.

4. A molding apparatus as defined in claim 1, and said stock magazine having a lower end disposed near and above the tops of said mold halves, said magazine having a forward side wall slot adapted to receive said knife, and a stock support element carried by said horizontal movement means below said knife and passing under the lower end of said magazine when said knife enters the magazine to cut off pieces of stock.

5. A molding apparatus as defined in claim 1, and said mechanism for converting rotational movement of said cam plate into reciprocatory motion of said horizontal movement means including vertically shiftable positively guided means driven by said cam follower and horizontal fixed axis rocker means operatively coupled with the horizontal movement means and with said vertically shiftable positively guided means.

6. A molding apparatus as defined in claim 5, and said vertically shiftable positively guided means disposed at the rear of said cam plate and the cam plate having a rear side groove receiving the cam follower of said mechanism.

7. A molding apparatus as defined in claim 6, and said fixed axis rocker means comprising a vertical rocker plate pivotally secured to said supporting means and having slotted connections with said vertically shiftable positively guided means and said horizontal movement means.

8. A molding apparatus as defined in claim 1, and said horizontal movement means comprising horizontally shiftable positively guided means on said supporting means, carriage means dependingly secured to said horizontally shiftable means, said knife being secured to the lower end portion of said carriage means, and said differential drive means comprising rotating gear means carried by the depending carriage means, and coacting fixed and shiftable horizontal racks secured respectively to the support means and the horizontal movement means.

9. A molding apparatus as defined in claim 8, and said rotating gear means including at least a pair of fixedly connected horizontal axis pinion gears of different diameters, the larger diameter pinion gear engaging the fixed rack on the supporting means and the smaller diameter pinion gear engaging and driving the shiftable rack of the horizontal movement means.

10. A molding apparatus as defined in claim 1, and said vertically movable carrier disposed forwardly of said cam plate, said cam plate having a second cam slot in its forward side receiving the follower of said vertically movable carrier to directly drive the carrier.

11. A molding apparatus as defined in claim 10, and said mold charging and stock advancing means connected on said carrier for limited relative movement and lost motion vertically when the carrier is shifted vertically in either direction.

12. A molding apparatus as defined in claim 11, and a projection on the top of the carrier adapted to engage said stock advancing means and move the same downwardly relative to said magazine when said stock advancing means lags behind the mold charging means during descent of the carriage due to said lost motion.

13. A molding apparatus as defined in claim 12, and a vertically adjustable pick-up and lifting means for said stock advancing means on the lower end of said carrier to raise the stock advancing means when the latter has lagged behind the mold charging means during the elevation of the carriage due to said lost motion.

14. A molding apparatus as defined in claim 1, and said horizontal movement connection between said mold charging and stock advancing means and said horizontal movement means comprising laterally spaced vertically grooved depending arms on said horizontal movement means straddling the mold charging and stock advancing means and receiving projecting horizontal pins at the opposite sides of the latter whereby horizontal movements of the grooved depending arms are transmitted through said projecting pins to said mold charging and stock advancing means.

15. A molding apparatus as defined in claim 15, and said mold charging means comprising a member on said carrier movable vertically therewith and being shiftable horizontally relative to the carrier and having mold charging finger elements adapted to carry a cut-off piece of stock to the vertical center of said mold halves, said member carrying said side projecting horizontal pins, and said stock advancing means comprising plate elements on opposite sides of said member and having stock advancing prongs projecting forwardly of the member and being received by vertical slots in the rear wall of said magazine, said plate elements being vertically slotted and receiving said side projecting pins in their slots to form a relative movement connection between said member and said plate elements in the vertical direction.

16. A molding apparatus as defined in claim 1, and a molded project unit encapsulating film dispensing, guidance, advancing, clamping and severing means on said supporting means and having its movable components motivated by said rotary cam plate.

17. A molding apparatus as defined in claim 16, and said film dispensing means including a pair of film supply spools on the supporting means substantially above the elevation of said mold halves.

18. A molding apparatus as defined in claim 17, and said guidance means comprising upper and lower fixed vertical film guide sections at the center of the apparatus and below said mold halves, said film advancing means disposed between said fixed guide sections, said clamping means comprising an upper film clamp adjacent the bottoms of the mold halves and a lower film clamp near the lower end of the lower guide section, and said film severing means including a horizontally shiftable knife immediately under the lower film clamp.

19. A molding apparatus as defined in claim 18, and said film guidance means additionally including a pair of spaced horizontal axis film web guide rolls on said supporting means and near said opposite sides of said magazine and below said film supply spools and substantially above the elevation of said mold halves.

20. A molding apparatus as defined in claim 18, and said film advancing means comprising an intermittently driven film advancing device having laterally spaced opposing pairs of endless belts which engage the film webs near and below the lower end of the upper fixed film guide section to drive the film downwardly.

21. A molding apparatus as defined in claim 20, and said belts comprising taut O-ring belts.

22. A molding apparatus as defined in claim 18, and said fixed film guide sections composed of spaced parallel opposing vertical channel elements through which edge portions of the film webs travel during advancing of the film.

23. A molding apparatus as defined in claim 20, and a vertically shiftable intermittent drive device including one-way active and one-way free wheeling rotational clutch means coupled with said film advancing means and having a cam follower driven by said cam plate.

24. A molding apparatus as defined in claim 23, and said last-named cam follower engaging the second-named groove in the forward side of the cam plate, which groove also receives the follower of said vertically movable carrier.

25. A molding apparatus as defined in claim 23, and said vertically shiftable intermittent drive device including a vertically shiftable member, a pair of gear racks secured to said member, and rotatable pinion gears on said intermittent drive device engage with said racks and being drive thereby.

26. A molding apparatus as defined in claim 18, and said upper film clamp including opposing horizontally movable spring-urged self-centering clamp sections and retriever-retraction means for said clamp sections responding to movements of said mold halves in one direction to release the spring-loaded clamp sections and causing the clamp sections to be retracted with the mold halves.

27. A molding apparatus as defined in claim 18, and said lower film clamp comprising a pair of horizontally swingable clamp arms, and means moving horizontally with said film severing means to move said clamp arms to parallel film clamping positions.

28. A molding apparatus as defined in claim 27, and cooperating spring-urged over dead center means to open said clamp arms to film releasing positions in response to reverse movement of said film severing means.

29. A molding apparatus as defined in claim 18, and means on said supporting means to adjust the elevation of said lower film clamp and horizontally shiftable knife so that the knife will sever the film midway between successive film encapsulated mold product units.

30. A molding apparatus as defined in claim 18, and second horizontal movement means on said supporting means and driven by said cam plate to move said knife of the film severing means horizontally.

31. A molding apparatus as defined in claim 30, and the horizontal movement means including a cam follower engaging in the groove formed in the rear side of said cam plate.

32. A molding apparatus as defined in claim 31, and the horizontal movement means further including vertically shiftable positively guided means attached to the last-named cam follower, a horizontal axis rocker plate operatively connected to the vertically shiftable means, and a positively guided horizontally shiftable means forming a part of said horizontal movement means operatively connected to said rocker plate.

* * * * *